US011622630B2

(12) United States Patent
Williams et al.

(10) Patent No.: US 11,622,630 B2
(45) Date of Patent: Apr. 11, 2023

(54) MOBILE BARBER CHAIR

(71) Applicants: Clifford Wayne Williams, Houston, TX (US); Kenneth Larkin Moore, Houston, TX (US)

(72) Inventors: Clifford Wayne Williams, Houston, TX (US); Kenneth Larkin Moore, Houston, TX (US)

( * ) Notice: Subject to any disclaimer, the term of this patent is extended or adjusted under 35 U.S.C. 154(b) by 0 days.

(21) Appl. No.: 17/386,516

(22) Filed: Jul. 27, 2021

(65) Prior Publication Data

US 2023/0031616 A1 Feb. 2, 2023

(51) Int. Cl.

| | |
|---|---|
| ***A47C 1/06*** | (2006.01) |
| ***A47C 3/30*** | (2006.01) |
| ***A47C 4/00*** | (2006.01) |
| ***A47C 4/52*** | (2006.01) |

(52) U.S. Cl.

CPC ..... *A47C 3/30* (2013.01); *A47C 1/06* (2013.01); *A47C 4/52* (2013.01)

(58) Field of Classification Search

CPC ..... A47C 1/06; A47C 3/30; A47C 4/52
USPC ..... 297/16.1, 16.2, 17, 183.5, 344.19, 297/423.1–423.46

See application file for complete search history.

(56) References Cited

U.S. PATENT DOCUMENTS 582,338 A * 5/1897 Birdsall ..... F16M 11/00 297/17 X
1,344,431 A * 6/1920 Albertie ..... A47C 4/286 297/16.1 X
1,422,319 A * 7/1922 Stoll ..... A47C 4/286 297/16.2 X
1,999,848 A * 4/1935 Ries ..... B66F 3/42 297/344.19 X
2,609,862 A * 9/1952 Pratt ..... A61G 7/1057 297/344.19 X
3,310,340 A * 3/1967 Brewer ..... A45B 5/00 297/16.2
3,745,937 A * 7/1973 Gail ..... A47C 5/10 297/17 X
3,763,651 A * 10/1973 Okiyama ..... A47C 3/30 297/344.19 X
3,891,270 A * 6/1975 Crossman ..... A47C 9/007 297/344.19 X
3,994,528 A * 11/1976 Humphrey ..... A47C 1/04 15/301
4,753,407 A * 6/1988 Brock ..... A47C 1/11 297/423.1
4,863,217 A * 9/1989 Fountain ..... A47C 1/06 297/241
5,039,167 A * 8/1991 Sweet ..... A47C 1/04 297/423.37
5,489,140 A * 2/1996 Van Horn-Plato ..... A47C 1/04 297/423.21 X
5,505,524 A * 4/1996 Drumwright ..... A47C 7/004 297/183.5

(Continued)

FOREIGN PATENT DOCUMENTS

FR 2585548 A1 * 2/1987

*Primary Examiner* — Rodney B White

(57) ABSTRACT

A height adjustable chair is disclosed. The chair is provided with a foldable seat and a base unit supporting a foldable seat. The base unit contains a column enclosing a hydraulic pump and a pair of collars attached to the hydraulic pump. The chair further contains a number of legs attached to one of the collars.

12 Claims, 4 Drawing Sheets

(56) References Cited

U.S. PATENT DOCUMENTS 6,015,130 A * 1/2000 Kigel ..... A47C 1/06 297/71 X
6,296,310 B1 * 10/2001 Laudenslayer ..... A47C 1/06 297/344.19
6,761,339 B2 * 7/2004 Minami ..... A47C 1/06 297/344.19 X
7,137,351 B2 * 11/2006 Picou ..... B63B 29/04 297/16.2
7,281,374 B2 * 10/2007 Obayashi ..... A61G 15/02 297/344.19 X
8,177,297 B2 * 5/2012 Powell ..... A47D 1/004 297/148
8,534,762 B2 * 9/2013 Linhoff ..... A47C 1/06 297/423.37
8,646,842 B2 * 2/2014 Barfuss ..... A47C 1/06 297/423.2 X
10,213,021 B2 * 2/2019 Walters ..... A47C 1/06
2002/0117878 A1 * 8/2002 Fox ..... A47C 4/286 297/16.2
2004/0212238 A1 * 10/2004 Chen ..... A47C 7/006 297/344.19
2006/0027158 A1 * 2/2006 Picou ..... B63B 29/04 114/363
2008/0296956 A1 * 12/2008 Barfuss ..... A47C 7/50 297/423.2 X
2009/0174232 A1 * 7/2009 Hoffman ..... A47C 4/42 297/16.1 X
2011/0095576 A1 * 4/2011 Reeb ..... A47C 9/105 297/16.2
2011/0133527 A1 * 6/2011 Taylor ..... A47C 7/5066 297/423.37
2011/0156449 A1 * 6/2011 Obolewicz ..... A47C 4/286 297/16.2
2011/0254325 A1 * 10/2011 Obolewicz ..... A47C 4/286 297/16.2
2014/0306493 A1 * 10/2014 Obolewicz ..... A47C 4/42 297/16.2

* cited by examiner

MOBILE BARBER CHAIR

FIELD OF INVENTION

The present invention relates to a chair. Specifically, the invention relates to a portable and height adjustable chair for indoor and outdoor use.

BACKGROUND OF THE INVENTION

A traditional chair present in the market provides height adjustability through a lever. The lever requires user's force to decrease the height of the rod supporting the seat. The height of the chair is adjusted but it puts a lot of pressure on the bottom unit making it weaker with time. There is no chair available in the market that provides a mechanism to adjust the height of the chair that does not require force of human sitting on the seat to pressurize the seat to go down when the lever is pulled.

Also, in the conventional chair, the legs remain on the ground and cannot used to adjust the height. The height adjustment is done by adjusting the height of the rod. By adjusting the height of the chair by changing the height of the rod, pressure on the rod is increased and the strength and durability of the rod are compromised. Moreover, there is nothing considerably and effectively present in the chair market that provides height adjustability along with stability to the chair, when in use and also a mechanism that does not compromise with the strength of the chair.

There is a requirement of a mechanism that requires almost negligible human force to adjust the height which puts almost no pressure on the rod and hence keeps the strength and durability of the rod intact. Along with this mechanism, a chair is required that does not put pressure on the rod supporting the chair to adjust the height.

Though the former prior art is better and more developed than the previous cited arts, it still lacks the extended legs that are rotatable and also it lacks some storage space. Also, there is no prior art that include a table with sleeves and rotatable extended legs for adjusting height. So, there is a need for a table which includes sleeves for storing utility items with height adjustable feature where the extended legs are rotatable, so we don't have to remove the leg physically to reduce the height and vice versa.

It is apparent now that numerous tables are developed in the prior art that are adequate for various purposes. Furthermore, even though these inventions may be suitable for the specific purposes to which they address, accordingly, they would not be suitable for the purposes of the present invention as heretofore described. Thus, there is a need for an improved table. Specifically, a height adjustable wine table is required.

SUMMARY OF THE INVENTION

The present invention discloses a barber chair with height adjustable mechanism. The barber chair includes a foldable seat resting on a base unit. The foldable seat is provided with a sitting and a backrest pivotally connected with each other. Furthermore, the sitting includes a lip member affixed at bottom. A plate on the base unit is connected with the lip by a spindle. The spindle on the lip is received by a column below the plate to secure the base unit with the foldable seat. The column includes a hydraulic pump with a pair of collars on each side.

The collar towards the plate is stationary while the collar towards bottom of the hydraulic pump is movable. A number of legs are affixed to movable collar. The height adjustment of the barber chair is achieved by movement of the movable collar along the column towards stationary collar. The movement of the movable collar allows the attached legs to collapse along and against the column.

Other objectives and aspects of the invention will become apparent from the following detailed description, taken in conjunction with the accompanying drawings, which illustrate, by way of example, the features in accordance with embodiments of the invention.

Embodiments of the present invention may employ any or all of the exemplary aspects above. Those skilled in the art will further appreciate the above-noted features and advantages of the invention together with other important aspects thereof upon reading the detailed description that follows in conjunction with the drawings, which illustrate, by way of example, the features in accordance with embodiments of the invention. The summary is not intended to limit the scope of the invention, which is defined solely by the claims attached hereto.

BRIEF DESCRIPTION OF THE DRAWINGS

Embodiments of the invention are described with reference to the following drawings, wherein.

DETAILED DESCRIPTION OF THE DRAWINGS

The present invention discloses a barber chair with height adjustable mechanism. The barber chair includes a foldable seat resting on a base unit. The foldable seat is provided with a sitting and a backrest pivotally connected with each other. Furthermore, the sitting includes a lip member affixed at bottom. A plate on the base unit is connected with the lip and a spindle. The spindle on the lip is received by a column below the plate to secure the base unit with the foldable seat. The column includes a hydraulic pump with a pair of collars on each side. The collar towards the plate is stationary while the collar towards bottom of the hydraulic pump is movable. A number of legs are affixed to movable collar. The height adjustment of the barber chair is achieved by movement of the movable collar along the column towards stationary collar. The movement of the movable collar allows the attached legs to collapse along and against the column.

Figure 1:
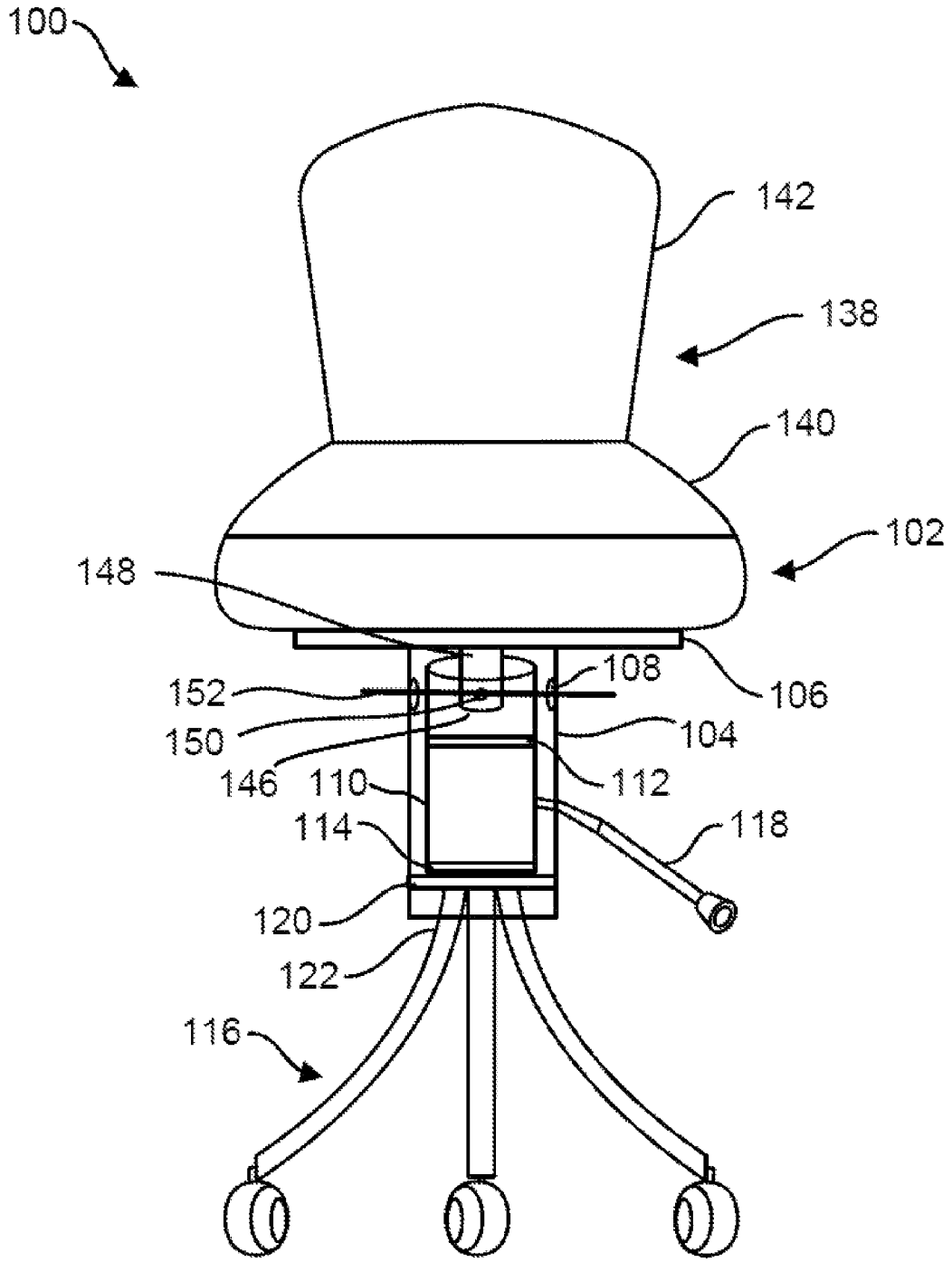
FIG. 1 illustrates a representative view of a chair.

FIG. 1 illustrates a chair 100 of the present invention. Preferably, the chair 100 is a height adjustable barber chair. The char 100 includes a base unit 102 and a foldable seat 138. The base unit 102 is capable of adjusting height of the chair 100. The base unit 102 includes a column 104 providing support to a plate 106. The column 104 includes a pair of openings 108 opposite to one another. The column 104 is a spiral-shaped hollow vertical rod enclosing a hydraulic pump 110. The column 104 is capable of adjusting the height of the chair 100 through the hydraulic pump 110.

The base unit 102 further includes a stationary collar 112 and a movable collar 114 positioned at top and bottom of the hydraulic pump 110. The stationary collar 112 is positioned at one-third distance from the top of the hydraulic pump 110 and the movable collar 114 attached at the bottom is further attached with a number of legs 116. In a preferred embodiment, the chair 100 includes three legs 116. In other embodiments, the chair 100 can include more than three legs 116.

The legs 116 provide balance to the base unit 102 to stand on a surface. The legs 116 are curved in shape for allowing easy collapsing of the legs 116 along and against the column 104 when the height of the chair 100 is adjusted. The legs 116 are attached to the movable collar 114 at equal distances.

The height of the chair 100 is adjusted through up and down movement of the movable collar 114 between the bottom of the hydraulic pump 110 and bottom of the column 104. A lever 118 attached to the base unit 102 is pulled and air pressure is generated by the hydraulic pump 110. The air pressure creates an air gap between the bottom end of the hydraulic pump and the movable collar. The air gap pushes the movable collar towards the bottom of the column and the legs attached to the movable collar extend out of the column to increase the height of the chair 100.

The base unit 102 further includes a stoppage mechanism 120 for preventing the movable collar 114 from sliding off the hydraulic pump 110. The lever 118 is pulled to decrease the air pressure and the movable 118 is pulled towards the bottom of the hydraulic pump 110. The legs collapse along and against the column to decrease the height of the chair 100. Additionally, the base unit 102 also includes a support rod 122 to prevent the legs 116 from spreading beyond a certain point. The support rod 122 is shorter in length with respect to the legs 116. The support rod 122 stands on the ground to provide balance and stability to the legs 116 in the extended configuration and prevents the legs 116 from expanding beyond a certain limit.

In another embodiment, the lever 118 attached to the movable collar 114. The lever 118 is capable of moving to and from between the bottom of the hydraulic pump 110 and the bottom of the column 104. The lever 118 slides the movable collar 114 between the bottom of the hydraulic pump 110 and the bottom of the column 104 for adjusting the height of the chair 100 and the legs 116 collapse along and against the column 104. The legs 116 come out of the column 104 in extended configuration when the lever 118 is moved towards the bottom of the column 104.

The foldable seat 138 is detachably attached to the base unit 102. The foldable seat 138 includes a seat portion 140 and a backrest 142 pivotally attached to the seat portion 140 through a hinged member 144. The backrest 142 is rotatable with respect to the seat portion 140 and collapses from open configuration to closed configuration. The backrest 142 rotates at an angle ranging between 0 and 180 degrees to change configuration of the foldable seat 138. The seat portion 140 is configured with a handle attached at a rear edge. In one embodiment, the seat portion 140 further includes a pair of arms attached to opposite sides of the seat portion 140. The foldable seat 138 further includes a lip member 146 attached to bottom of the seat portion 140. The foldable seat 138 also includes a spindle 148 attached to the lip member 146.

The spindle 148 includes a pair of holes 150 opposite to one another. The foldable seat 138 is detachably attached to the base unit 102 through the plate 106. The plate 106 is capable of receiving the lip member 146 of the seat portion 140 along with a spindle 148. The lip member 146 is locked with the base unit 102 and the spindle 148 passes through an aperture 122 in the plate 106 and attaches to the column 104. The holes 150 in the spindle are aligned in same horizontal plane with the openings 108 in the column and an affixing member 152 is passed through the holes 150 and the openings 108 to lock the spindle 148 within the column 104.

Figure 2:
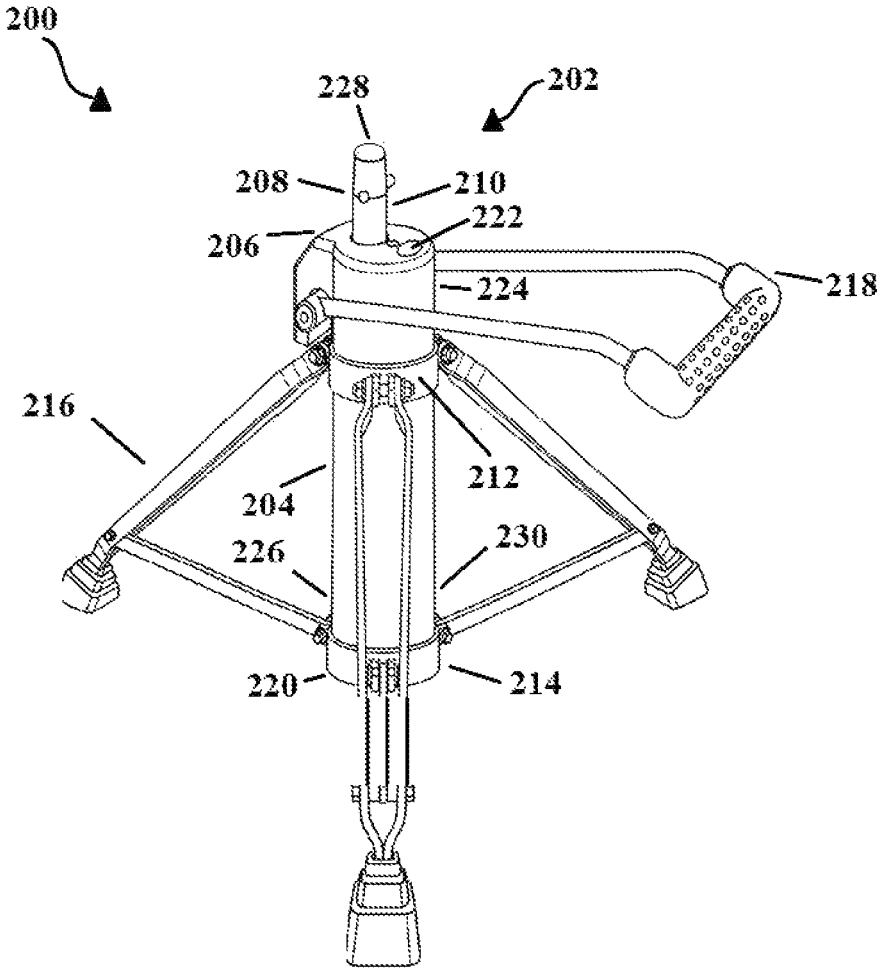
FIG. 2 illustrates a base unit of the chair.

FIG. 2 illustrates a base unit 202 of the chair 200. The base unit 202 is capable of adjusting height of the chair 200. The base unit 202 receives a foldable seat to provide a sitting space. The foldable seat is detachably attached to the base unit 202. The base unit 202 includes a column 204 supported by a number of legs 216. The column 204 provides support to the foldable seat. The column 204 is vertical in dimensions and contains a pair of openings 208 opposite to another. The column 204 further includes a first end 224 and a second end 226. The first end 224 is attached to a plate 206 supporting the foldable seat. The plate 206 receives a lip member of a seat portion of the foldable seat. The plate 206 contains an aperture 222 in center. A spindle from the seat portion passes through the aperture 222 and engages with the column 204. The spindle contains a pair of holes opposite to one another. The holes and the openings 208 are aligned with one another in a same horizontal plane for allowing a passage of an affixing member. The affixing member locks the spindle within the column 204. The second end 226 is attached to the legs 216. The column 204 is spiral shaped and encloses a hydraulic pump 210.

The hydraulic pump 210 is present to adjust height of the chair 200. The hydraulic pump 210 includes a top end 228 towards the first end 224 of the column 204 and a bottom end 230 towards to second end 226 of the column 204. The column 204 further includes a stationary collar 212 and a movable collar 214. The stationary collar 212 is positioned towards the top end 228 of the hydraulic pump 210. Preferably, the stationary collar 212 is positioned at one-third distance from the top end 228 of the hydraulic pump 210. The movable collar 214 is positioned at the bottom end 230 of the hydraulic pump 210. The movable collar 214 is further attached to the legs 216. In a preferred embodiment, the base unit 202 includes three legs 216. In other embodiments, the base unit 202 includes more than three legs 216. The legs 216 are attached to the movable collar 214 at equal distances. Each of the three legs 216 includes a front end 230 and a rear end 232. The front end 230 is attached to the movable collar 214 and the rear end 232 stands on ground to provide support to the chair 200.

The base unit 202 further includes a lever 218. The lever 218 is pulled to adjust the height of the chair 200. The lever 218 is attached to periphery of the column 204. The lever 218 is pulled and air pressure is generated by the hydraulic pump 210. The air pressure creates an air gap between the bottom end of the hydraulic pump 210 and the movable collar 214. The air gap pushes the movable collar 214 towards the bottom of the column 204 and the legs 216 attached to the movable collar 214 extend out of the column 204 to increase the height of the chair 200.

The base unit 202 further includes a stoppage mechanism 220 for preventing the movable collar 214 from sliding off the hydraulic pump 210. The lever 218 is pulled to decrease the air pressure and the movable is pulled towards the bottom of the hydraulic pump 210. The legs 216 collapse along and against the column 204 to decrease the height of the chair 200. Additionally, the base unit 202 also includes a support rod 222 to prevent the legs 216 from spreading beyond a certain point. The support rod 222 is shorter in length with respect to the legs 216. The support rod 222 stands on the ground to provide balance and stability to the legs 216 in the extended configuration and prevents the legs 216 from expanding beyond a certain limit.

In another embodiment, the lever 218 attached to the movable collar 214. The lever 218 is capable of moving to and from between the bottom of the hydraulic pump and the bottom of the column. The lever 218 slides the movable collar 214 between the bottom of the hydraulic pump and the bottom of the column for adjusting the height of the chair and the legs 216 collapse along and against the column. The legs 216 come out of the column in extended configuration when the lever 218 is moved towards the bottom of the column.

Figure 3:
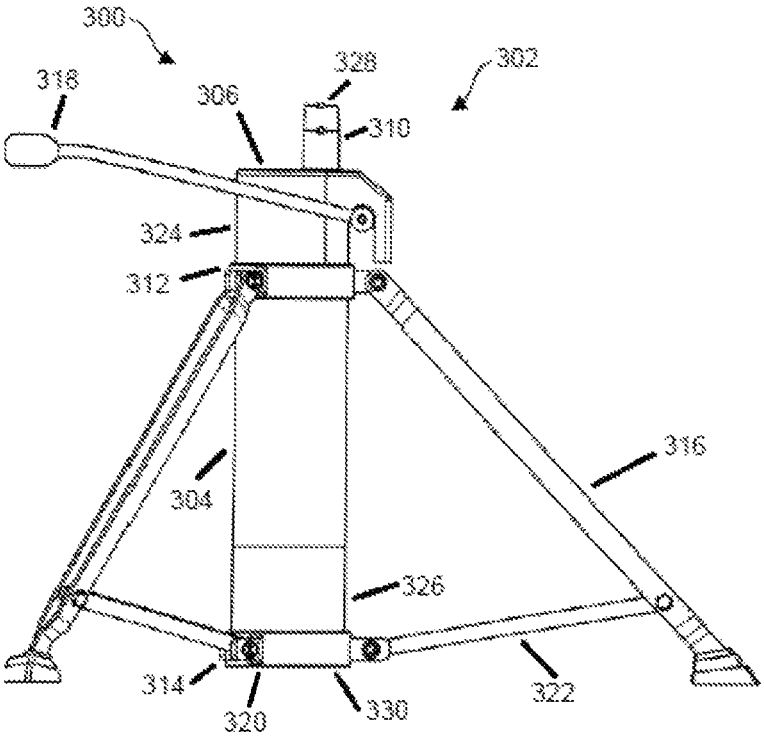
FIG. 3 illustrates another view of the base unit.

FIG. 3 illustrates a column 302 of the chair 300. The column 302 is a height adjustable vertical post 304 with a first end 324 and a second end 326. The first end 324 includes a plate 306 to receive a foldable seat and the second end 326 is capable of receiving a number of legs 316 when the height of the chair is adjusted. The column encloses a hydraulic pump 310, a stationary collar 312, and a movable collar 314. The hydraulic pump 310 is present for adjusting height of the chair. The hydraulic pump 310 includes a top end 328 and a bottom end 330.

The top end 328 is towards the first end 324 of the column 302 and the bottom end 330 is towards the second end 326. The hydraulic pump 310 is attached to the stationary collar 312 and the movable collar 314. The stationary collar 312 is positioned at a one-third distance from the top end 328 and the movable collar 314 is positioned at the bottom end 330 of the hydraulic pump 310. The movable collar 314 is further attached to a number of legs 316 providing support to the chair at ground. In a preferred embodiment, the chair stands on a tetra-base unit of three legs. In other embodiments, the chair can include more than three legs.

The base unit further includes a lever 318. The lever 318 is pulled to adjust the height of the chair 300. The lever 318 is attached to periphery of the column 304. The lever 318 is pulled and air pressure is generated by the hydraulic pump 310. The air pressure creates an air gap between the bottom end 330 of the hydraulic pump 310 and the movable collar 314. The air gap pushes the movable collar 314 towards the bottom of the column 304 and the legs 316 attached to the movable collar 314 extend out of the column 304 to increase the height of the chair 300.

The base unit 302 further includes a stoppage mechanism 320 for preventing the movable collar 314 from sliding off the hydraulic pump 310. The lever 318 is pulled to decrease the air pressure and the movable collar 314 is pulled towards the bottom of the hydraulic pump 310. The legs collapse along and against the column 304 to decrease the height of the chair 300.

Additionally, the base unit 302 also includes a support rod 322 to prevent the legs from spreading beyond a certain point. The support rod 322 is shorter in length with respect to the legs 316. The support rod 322 may stand on the ground to provide balance and stability to the legs 316 in the extended configuration and prevents the legs 316 from expanding beyond a certain limit.

Figure 4:
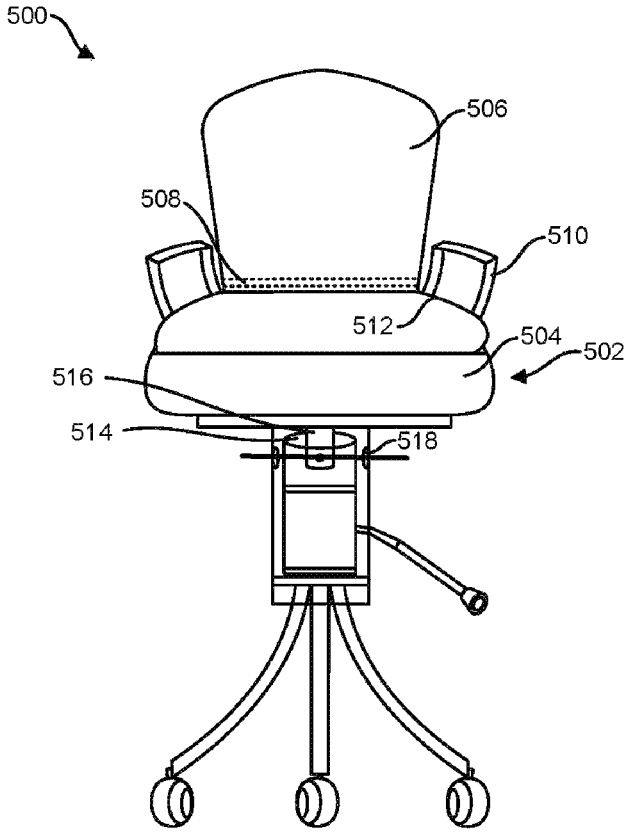
FIG. 4 illustrates a closed configuration of the base unit of the chair.

FIG. 4 illustrates a foldable seat 502 of the chair 500. The foldable seat 502 detachably attaches to a base unit of the chair 500. The foldable seat 502 includes a seat portion 504 and a backrest 506. The backrest 506 is pivotally attached to the seat portion 504 through a hinged member 508. The backrest 506 is capable of rotating with respect to the seat portion 504 in open configuration and close configuration. The backrest 506 rotates at an angle between 0 and 180 degrees to change configuration of the foldable seat 502 from the open configuration to the close configuration and vice-versa.

The seat portion 504 is configured with a handle 510 attached at a rear edge 512. In one embodiment, the seat portion further includes a pair of arms attached to opposite sides of the seat portion. The seat portion further includes a lip member 514 and a spindle 516 attached to the lip member 514. The seat portion 504 is attached to the base unit through the lip member 514 and the spindle 516. The lip member 514 is received by a plate of the base unit to attach the foldable seat 502 to the base unit. The spindle 516 includes a pair of holes 518 opposite to one another and passes through an aperture in the plate of the base unit to engage with a column of the base unit.

While various embodiments of the present invention have been described above, it should be understood that they have been presented by way of example only, and not of limitation. Likewise, the figure may depict an example architectural or other configuration for the invention, which is done to aid in understanding the features and functionality that can be included in the invention. The invention is not restricted to the illustrated example architectures or configurations, but the desired features can be implemented using a variety of alternative architectures and configurations.

Although the invention is described above in terms of various exemplary embodiments and implementations, it should be understood that the various features, aspects and functionality described in one or more of the individual embodiments are not limited in their applicability to the particular embodiment with which they are described, but instead can be applied, alone or in various combinations, to one or more of the other embodiments of the invention, whether or not such embodiments are described and whether or not such features are presented as being a part of a described embodiment. Thus, the breadth and scope of the present invention should not be limited by any of the above-described exemplary embodiments.

The presence of broadening words and phrases such as "one or more," "at least," "but not limited to" or other like phrases in some instances shall not be read to mean that the narrower case is intended or required in instances where such broadening phrases may be absent.

The invention claimed is:

1. A chair, the chair comprising:

a foldable seat which further comprises a lip, a plate, and a bottom, wherein the lip is secured to the bottom of the foldable seat by the plate;

a base unit supporting the foldable seat, the base unit comprising:

a column, wherein the column comprises:

a hydraulic pump within the column, wherein the hydraulic pump further comprises a top and a bottom;

a stationary collar placed at a position from the top of the hydraulic pump;

a movable collar placed at the bottom of the hydraulic pump, wherein the movable collar is movable within the bottom of the hydraulic pump and the stationary collar; and at least three legs attached to the movable collar, wherein movement of the movable collar within the bottom of the hydraulic pump towards the stationary collar allows the at least three legs to collapse along and lie against the column of the base unit.

2. The foldable seat according to claim 1, further comprising a seat and a backrest connected to the seat through a hinged member.

3. The foldable seat according to claim 2, wherein the bottom of the foldable seat further comprises a spindle, wherein the spindle is engaged with the column.

4. The foldable seat according to claim 1, wherein at least one handle is affixed to an edge of the seat.

5. The chair according to claim 1, wherein the foldable seat is detachable from the base unit at the lip.

6. The chair according to claim 1, wherein the stationary collar is positioned at a distance one-third of the way from the top of the hydraulic pump.

7. The chair according to claim 1, wherein the base unit includes a stoppage unit to prevent the movable collar from sliding off the hydraulic pump.

8. The chair according to claim 1, wherein the base unit further includes a support rod for preventing the at least three legs from spreading beyond a limit.

9. The chair according to claim 1, wherein the base unit further includes a lever for adjusting the height of the chair.

10. The chair according to claim 1, wherein the chair is a barber chair.

11. A system comprising:

a base unit, the base unit comprising a column, the column including:

a hydraulic pump, the hydraulic pump having a top and a bottom;

a stationary collar placed at a position from the top of the hydraulic pump;

a movable collar placed at the bottom of the hydraulic pump, wherein the movable collar is movable within the bottom of the hydraulic pump and the stationary collar;

three or more legs attached to the movable collar, wherein movement of the movable collar within the bottom of the hydraulic pump towards the stationary collar allows the three or more legs to collapse along and lie against the column of the base unit;

a lever connected to the movable collar, wherein the lever provides height adjustment of the base unit; and a retention unit, the retention unit preventing the movable collar from falling off the hydraulic pump.

12. The system according to claim 11, wherein the base unit includes a support rod to prevent the three or more legs from spreading beyond a specified limit.

* * * * *